US009201385B2

(12) United States Patent
Fujita et al.

(10) Patent No.: US 9,201,385 B2
(45) Date of Patent: Dec. 1, 2015

(54) MOVING DEVICE AND IMAGE FORMING APPARATUS INCLUDING THE MOVING DEVICE

(71) Applicants: Masanari Fujita, Osaka (JP); Kenji Nakamura, Osaka (JP)

(72) Inventors: Masanari Fujita, Osaka (JP); Kenji Nakamura, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 28 days.

(21) Appl. No.: 13/860,575

(22) Filed: Apr. 11, 2013

(65) Prior Publication Data

US 2013/0315625 A1 Nov. 28, 2013

(30) Foreign Application Priority Data

May 23, 2012 (JP) ..... 2012-117882
Jan. 29, 2013 (JP) ..... 2013-013963

(51) Int. Cl.
*G03G 21/16* (2006.01)

(52) U.S. Cl.
CPC ..... *G03G 21/1628* (2013.01); *G03G 21/1666* (2013.01)

(58) Field of Classification Search
CPC ..... G03G 21/1628; G03G 21/1633
USPC ..... 399/125
See application file for complete search history.

(56) References Cited

U.S. PATENT DOCUMENTS

2009/0252528 A1* 10/2009 Yamaguchi ..... 399/111
2012/0070189 A1* 3/2012 Okabe ..... 399/111
2014/0044450 A1* 2/2014 Nakamura ..... 399/110

FOREIGN PATENT DOCUMENTS

| | | |
|---|---|---|
| JP | 2000-181164 | 6/2000 |
| JP | 2007-065125 | 3/2007 |
| JP | 2009-157001 | 7/2009 |
| JP | 2009-157137 | 7/2009 |
| JP | 2010-271743 | 12/2010 |
| JP | 2011-022331 | 2/2011 |

* cited by examiner

*Primary Examiner* — Ryan Walsh
*Assistant Examiner* — Philip Marcus T Fadul
(74) *Attorney, Agent, or Firm* — Harness, Dickey & Pierce

(57) ABSTRACT

An image forming apparatus includes a housing including an opening to house a plurality of latent image bearing members for bearing latent images and latent image forming devices for forming the latent images, and an openably and closable holder to hold the latent image forming devices. The holder with one end thereof pivotally supported by the housing moves the latent image forming devices from an engaged position at which the latent image forming devices form the latent images to a retracted position at which the latent image forming devices are separated from the latent image bearing members as the holder moves to an open position at which the opening of the housing is opened. As the holder is opened, at least one of the latent image forming devices, which is closest to a fulcrum of the holder, is positioned at an end of the housing pivotally supporting the holder.

19 Claims, 9 Drawing Sheets

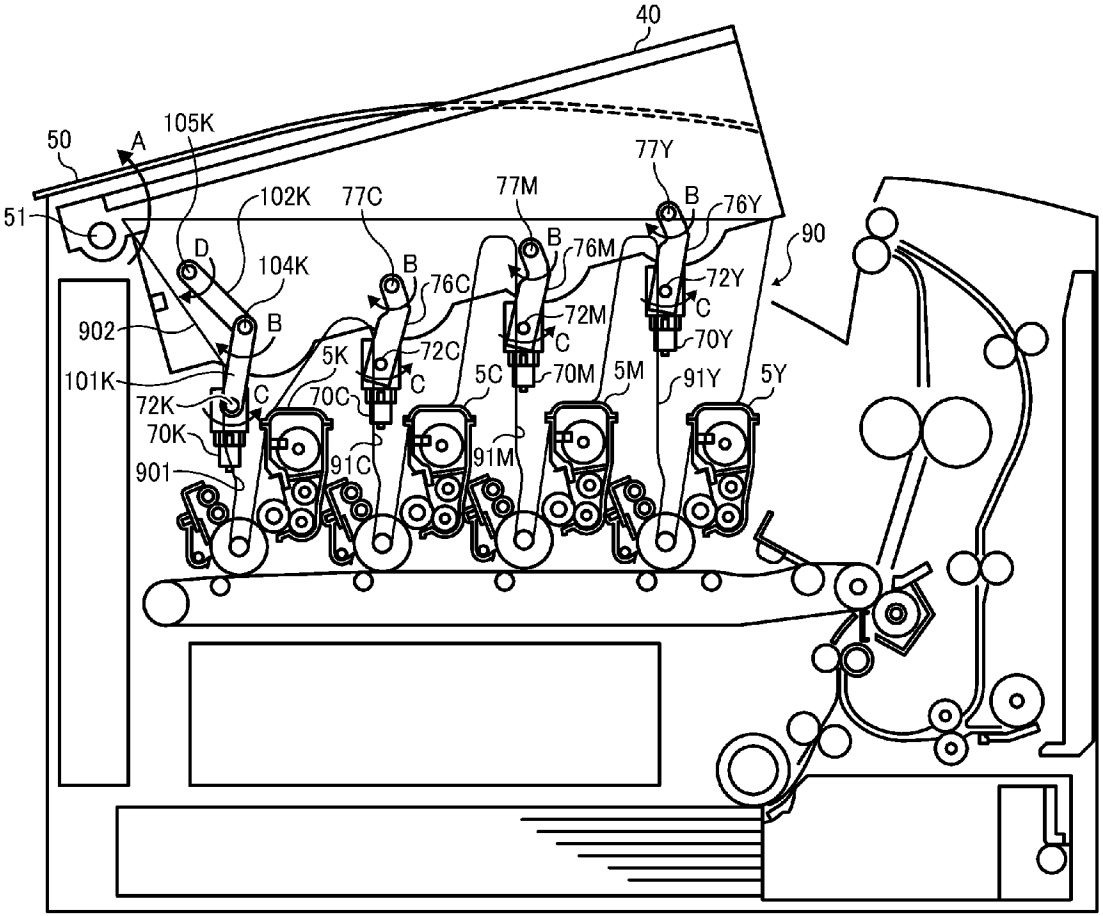
FIG. 8
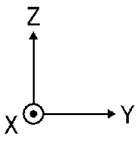

MOVING DEVICE AND IMAGE FORMING APPARATUS INCLUDING THE MOVING DEVICE

CROSS-REFERENCE TO RELATED APPLICATIONS

This patent application is based on and claims priority pursuant to 35 U.S.C. §119 from Japanese Patent Application Nos. 2012-117882, filed on May 23, 2012, and 2013-013963, filed on Jan. 29, 2013, both in the Japan Patent Office, which are hereby incorporated herein by reference in their entirety.

BACKGROUND

1. Technical Field

Exemplary aspects of the present disclosure generally relate to an image forming apparatus, such as a copier, a facsimile machine, a printer, or a multi-functional system including a combination thereof.

2. Description of the Related Art

Known color image forming apparatuses include tandem-type image forming apparatuses in which toner images of different colors, also known as visible images, are formed on a plurality of latent image bearing members (which may, for example, be photosensitive drums) for different colors arranged in tandem along an intermediate transfer member or a sheet conveyer in its moving direction and superimposed one atop the other, thereby forming a color image. Around each of the latent image bearing members, imaging devices such as a charging device for charging the surface of the latent image bearing member, a writing head for illuminating the surface thereof to form a latent image, a developing device for developing the latent image, and so forth are disposed.

Image forming apparatuses of this kind include a type equipped with a plurality of writing heads held by a movable top cover of the image forming apparatus. The top cover serves as a holder for holding the plurality of the writing heads and is rotatably movable about a shaft provided at one end thereof in the direction in which the plurality of the latent image bearing members are arranged. The top cover covers the upper portion of the image forming apparatus, and with the top cover closed the plurality of the writing heads is positioned at an engaged position at which the writing heads form latent images on the surface of the latent image bearing members. When the top cover is opened, the plurality of the writing heads move together with the top cover, moving from the engaged position to a retracted position.

Moving the writing heads to the retracted position allows image forming units each equipped with the latent image bearing member, the charging device, and the developing device to be removed vertically. The image forming units can be taken out from an upper opening opened by the upper cover.

With reference to FIGS. 10A and 10B, a description is provided of a known image forming apparatus with a movable cover. FIG. 10A is a schematic diagram illustrating a conventional image forming apparatus with a top cover 500 closed. FIG. 10B is a schematic diagram illustrating the conventional image forming apparatus with the top cover 500 opened when removing image forming units 300Y, 300M, 300C, and 300K.

As illustrated in FIG. 10A, in the image forming apparatus, a middle cover 410 which holds each of writing heads 700Y, 700M, 700C, and 700K is rotatably attached to a shaft 510 to which the top cover 500 is also rotatably attached. More specifically, the writing heads 700Y, 700M, 700C, and 700K are rotatably attached to one end of each of arms 760Y, 760M, 760C, and 760K, respectively. The other end of each of the arms 760Y, 760M, 760C, and 760K is pivotally attached to the middle cover 410. The middle cover 410 also holds toner cartridges 130Y, 130M, 130C, and 130K storing toner. As the top cover 500 and the middle cover 410 are moved in the counterclockwise direction in FIG. 10A, the upper portion of a housing 900 of the image forming apparatus is opened, allowing image forming units 300Y, 300M, 300C, and 300K to be removed therefrom.

If the left side of the image forming apparatus (i.e., at a fulcrum side of the top cover 500, that is, the shaft 510 side) is a wall and/or an object with a height higher than that of the image forming apparatus is disposed at the left side, the top cover 500 and the middle cover 410 cannot rotate more than 90 degrees as illustrated in FIG. 10B.

In FIG. 10B, an area T indicated by a double-headed arrow refers to an area in which the image forming unit 300K passes when the image forming unit 300K disposed at the fulcrum side of the middle cover 410 (the left hand side in FIG. 10B) is installed and removed from the housing 900. As illustrated in FIG. 10B, if the top cover 500 and the middle cover 410 are not allowed to turn more than 90 degrees, the writing head 700K at the fulcrum side of the middle cover 410 enters the area T. As a result, when removing the image forming unit 300K from the housing 900, the image forming unit 300K contacts and may damage the writing head 700K.

In view of the above, there is an unsolved need for an image forming apparatus which allows components to be removed therefrom without contacting imaging devices.

SUMMARY

In view of the foregoing, in an aspect of this disclosure, there is provided an improved image forming apparatus including a plurality of latent image bearing members, a plurality of latent image forming devices, a housing, and an openably closable holder. The plurality of latent image bearing members rotates about a shaft and bears a latent image on a surface thereof. The plurality of latent image forming devices forms the latent image on the surface of the plurality of latent image bearing members. The housing includes an opening and houses the plurality of latent image bearing members and the plurality of latent image forming devices. One end of the openably closable holder is pivotally supported by the housing and moves the plurality of latent image forming devices from an engaged position at which the plurality of latent image forming devices forms the latent image to a retracted position at which the latent image forming devices are separated from the latent image bearing members as the holder moves to an open position at which the opening of the housing is opened. In a state in which the holder is at the open position, at least one of the plurality of latent image forming devices, which is closest to a fulcrum of the holder among the plurality of latent image forming devices, is positioned at an end of the housing pivotally supporting the holder relative to a line connecting other latent image forming devices as viewed from an axial direction of the latent image bearing member.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 8 is a schematic diagram illustrating the middle cover as the middle cover starts to open;

DETAILED DESCRIPTION

Figure 1:
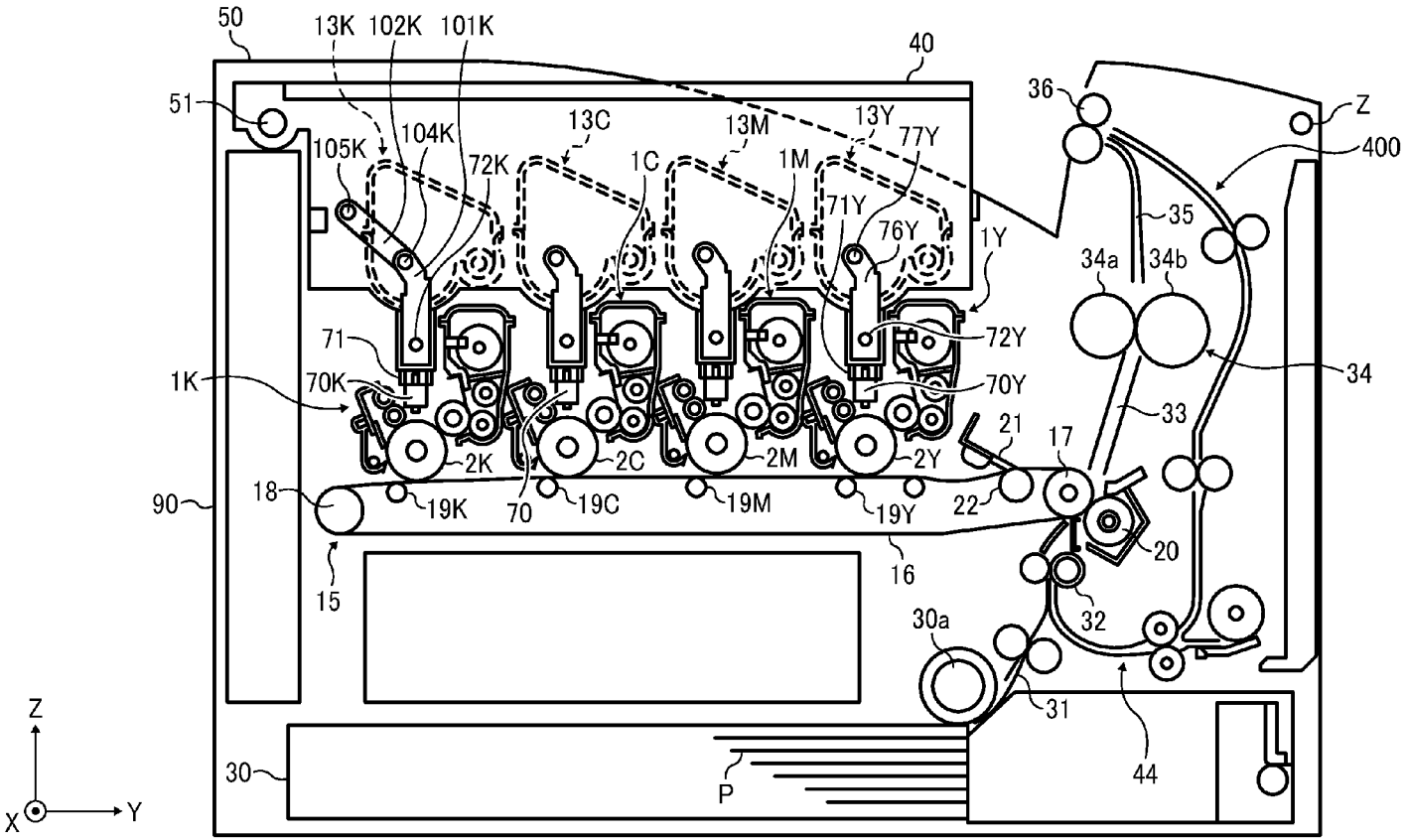
FIG. 1 is a schematic diagram illustrating a printer as an example of an image forming apparatus, according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating an electrophotographic printer as an example of an image forming apparatus according to an illustrative embodiment of the present invention.

As illustrated in FIG. 1, the image forming apparatus includes four image forming units 1Y, 1M, 1C, and 1K (which may be collectively referred to as image forming units 1) for forming toner images of yellow, magenta, cyan, and black, respectively. It is to be noted that the suffixes Y, M, C and K denote colors yellow, magenta, cyan, and black, respectively. To simplify the description, these suffixes are omitted herein, unless otherwise specified. The image forming units 1Y, 1M, 1C, and 1K all have the same configuration as all the others, differing only in the color of toner employed. Thus, a description is provided of the image forming unit 1K for forming a toner image of black color as a representative example of the image forming units 1Y, 1M, 1C, and 1K. The image forming units 1Y, 1M, 1C, and 1K are replaced upon reaching their product life cycles.

Figure 2:
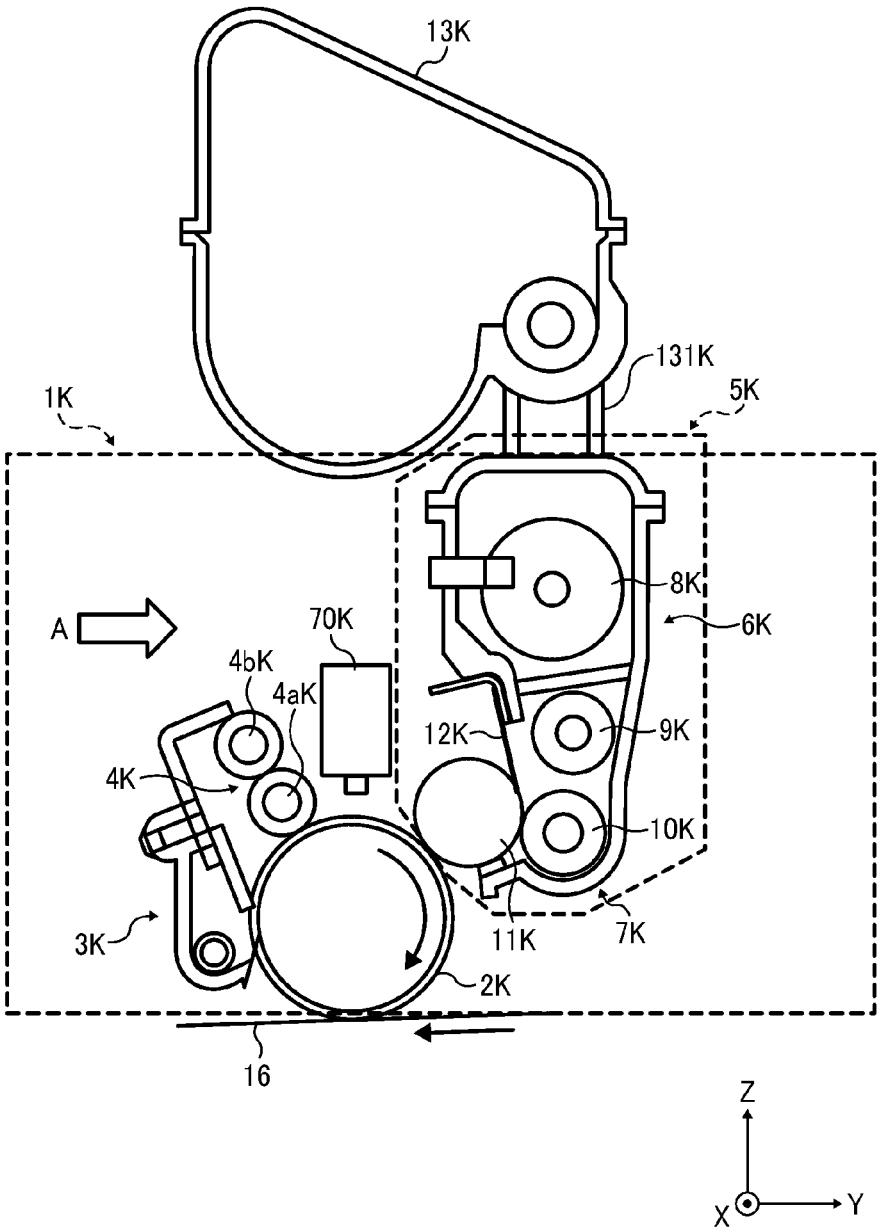
FIG. 2 is a schematic diagram illustrating an image forming unit for the color black as an example of image forming units employed in the image forming apparatus of FIG. 1.

With reference to FIG. 2, a description is provided of the image forming unit 1K as an example of the image forming units. FIG. 2 is a schematic diagram illustrating the image forming unit 1K. The image forming unit 1K includes a photosensitive drum 2K serving as a latent image bearing member and various pieces of imaging equipment, such as a charging device 4K, a developing device 5K, a drum cleaner 3K, and a charge neutralizing device (not illustrated). The image forming unit 1K is detachably attachable relative to the image forming apparatus, thereby allowing replacement of consumables at once.

The charging device 4K includes a charging roller 4*a*K that contacts and charges uniformly the photosensitive drum 2K rotating in the clockwise direction indicated by an arrow in FIG. 2. The photosensitive drum 2K is rotated by a driving device. The charging roller 4*a*K rotates in the counterclockwise direction while contacting or approaching the photosensitive drum 2K to generate an electrical discharge therebetween, thereby charging uniformly the surface of the photosensitive drum 2K.

The uniformly charged surface of the photosensitive drum 2K is exposed by a writing head 70K, thereby forming an electrostatic latent image for black color on the surface thereof. The electrostatic latent image for black on the photosensitive drum 2K is developed with black toner by the developing device 7K. Accordingly, a visible image, also known as a toner image (in this example, a black toner image), is formed on the photosensitive drum 2K. As will be described later, the toner image is transferred primarily onto an intermediate transfer belt 16.

The drum cleaner 3K removes residual toner remaining on the photosensitive drum 2K after the transfer process described above. The residual toner removed by the drum cleaner 3K is delivered to the end of a casing of the image forming unit 1K by a screw and discharged therefrom to a waste toner bin.

The charge neutralizing device removes residual charge remaining on the photosensitive drum 2K after the surface thereof is cleaned by the drum cleaner 3K in preparation for the subsequent imaging cycle. The surface of the photosensitive drum 2K is initialized. Similar to the image forming unit 1K, toner images for yellow, magenta, and cyan are formed on the photosensitive drums 2Y, 2M, and 2C, respectively, and then transferred to the intermediate transfer belt 16.

As illustrated in FIG. 2, the developing device 5K includes a developing portion 7K and a vertically-long toner hopper 6K storing black toner. The toner hopper 6K includes an agitator 8K and a mixing paddle 9K disposed below the agitator 8K. The agitator 8K and the mixing paddle 9K are rotated by a driving device. Substantially below the mixing paddle 9K, a toner feed roller 10K rotated by the driving device is disposed. The black toner in the toner hopper 6K is mixed by the agitator 8K and the mixing paddle 9K and moved to the toner feed roller 10K under its own weight. The toner feed roller 10K includes a metal cored bar covered with a foam resin or the like and rotates while the toner in the toner hopper 6K is adhered to the surface of the toner feed roller 10K.

The developing portion 7K of the developing device 5K includes a developing roller 11K and a thinning blade 12K. The developing roller 11K rotates while contacting the photosensitive drum 2K and the toner feed roller 10K. The tip of the thinning blade 12K contacts the surface of the developing roller 11K. The black toner adhered to the toner feed roller 10K in the toner hopper 6K is supplied to the surface of the developing roller 11K at a contact portion at which the developing roller 11K and the toner feed roller 10K contact. As the supplied black toner passes through a place at which the developing roller 11K and the thinning blade 12K contact, the thickness of the toner layer on the surface of the developing roller 11K is adjusted. After the thickness of the toner layer is adjusted, the toner is adhered to the electrostatic latent image on the surface of the photosensitive drum 2K at a developing area at which the developing roller 11K and the photosensitive drum 2K contact. Accordingly, the electrostatic latent image is developed with toner into a visible image known as a black toner image.

The writing head 70 includes a plurality of light emitting elements such as LEDs and organic EL devices arranged in the longitudinal direction of the photosensitive drum 2K, and a plurality of rod lenses arranged between the photosensitive drum 2K and the light emitting elements in the longitudinal direction of the photosensitive drums 2K. Based on image information, the light emitting elements at a predetermined position in the writing head 70K illuminate the photosensitive drum 2K, thereby forming an electrostatic latent image on the surface of the photosensitive drum 2K.

A toner cartridge 13K (13Y, 13M, 13C) is disposed substantially at the upper portion of the image forming unit 1K (1Y, 1M, 1C). The toner cartridge 13K and the developing device 5K are connected by a supply tube 131, and in accordance with consumption of the toner in the developing device 5K, the toner in the toner cartridge 13K is supplied to the developing device 5K via the supply tune 131.

Similar to the image forming unit 1K, toner images of yellow, magenta, and cyan are formed on the photosensitive drums 2Y, 2M, and 2C of the image forming units 1Y, 1M, and 1C, respectively.

Referring back to FIG. 1, a description is provided of a transfer unit 15. The transfer unit 15 is disposed below the image forming units 1Y, 1M, 1C, and 1K. The transfer unit 15 includes an intermediate transfer belt 16 serving as an image bearing member formed into an endless loop and rotated in the counterclockwise direction. The transfer unit 15 also includes a driving roller 17, a driven roller 18, four primary transfer rollers 19Y, 19M, 19C, and 19K, a secondary transfer roller 20, a belt cleaning device 21, a cleaning auxiliary roller 22 and so forth.

The intermediate transfer belt 16 is entrained around and stretched taut between the driving roller 17, the driven roller 18, the cleaning auxiliary roller 22, and four primary transfer rollers 19Y, 19M, 19C, and 19K (which may be collectively referred to as the primary transfer rollers 19, unless otherwise specified.) The driving roller 17 is rotated in the counterclockwise direction by a motor or the like, and rotation of the driving roller 17 enables the intermediate transfer belt 16 to rotate in the same direction.

The intermediate transfer belt 16 is interposed between the photosensitive drums 2Y, 2M, 2C, and 2K, and the primary transfer rollers 19Y, 19M, 19C, and 19K. Accordingly, primary transfer nips are formed between the front surface or the image bearing surface of the intermediate transfer belt 16 and the photosensitive drums 2Y, 2M, 2C, and 2K.

The primary transfer rollers 19Y, 19M, 19C, and 19K are supplied with a primary bias by a transfer bias power source, thereby generating a transfer electric field between the electrostatic latent images on the photosensitive drums 2Y, 2M, 2C, and 2K, and the primary transfer rollers 19Y, 19M, 19C, and 19K. According to the present illustrative embodiment, a roller-type primary transfer device is used as the primary transfer rollers 19Y, 19M, 19C, and 19K. Alternatively, a transfer charger and a brush-type transfer device may be employed as a primary transfer device.

As the photosensitive drum 2Y rotates and the yellow toner image formed on the photosensitive drum 2Y of the image forming unit 1Y enters the primary transfer nip at which the photosensitive drum 2Y contacts the intermediate transfer belt 16, the yellow toner image is transferred from the photosensitive drum 2Y to the intermediate transfer belt 16. Subsequently, as the intermediate transfer belt 16 bearing the yellow toner image moves, passing through the primary transfer nips for the colors magenta, cyan, and black, the toner images of the colors magenta, cyan, and black formed on the photosensitive drums 2M, 2C, and 2K are primarily transferred on top of the yellow toner image on the intermediate transfer belt 16 so that they are superimposed one atop the other, thereby forming a composite toner image on the intermediate transfer belt 16.

The secondary transfer roller 20 of the transfer unit 15 is disposed outside the loop formed by the intermediate transfer belt 16, across from the driven roller 17 which is disposed inside the looped intermediate transfer belt 16. In other words, the intermediate transfer belt 16 is interposed between the driven roller 17 and the secondary transfer roller 20, thereby forming a secondary transfer nip between the front surface of intermediate transfer belt 16 and the secondary transfer roller 20. The secondary transfer roller 20 is supplied with a secondary transfer bias from a secondary transfer bias power source. Upon application of the secondary transfer bias, a secondary transfer electric field is formed between the secondary transfer roller 20 and the driven roller 17 which is grounded.

A sheet tray 30 storing a stack of recording media P is disposed vertically below the transfer unit 15 and is slidably detachable and attachable relative to the housing 90 of the image forming apparatus. The sheet tray 30 includes a sheet feed roller 30*a* that contacts a top sheet of the stack of the recording media P and rotates in the counterclockwise direction at certain times to feed the recording medium P to a sheet path 31 in the image forming apparatus.

Substantially at the end of the sheet path 31, a pair of registration rollers 32 is disposed. The pair of the registration rollers 32 stops rotating temporarily as soon as the recording medium P is interposed therebetween. The pair of registration rollers 32 starts to rotate again to feed the recording medium P to the secondary transfer nip in appropriate timing such that the recording medium P is aligned with the composite toner image formed on the intermediate transfer belt 16 in the secondary transfer nip.

In the secondary transfer nip, the recording medium P tightly contacts the composite toner image on the intermediate transfer belt 16, and the composite toner image is transferred onto the recording medium P by the secondary transfer electric field and the nip pressure applied thereto. The recording medium P onto which the composite color toner image is transferred passes through the secondary transfer nip and then separates from the secondary transfer roller 20 and the intermediate transfer belt 16. Subsequently, the recording medium P is delivered to a fixing device 34 via a post-transfer sheet path 33.

After the intermediate transfer belt 16 passes through the secondary transfer nip, residual toner not having been transferred onto the recording medium P remains on the intermediate transfer belt 16. Such residual toner is removed from the intermediate transfer belt 16 by the belt cleaning device 21 which contacts the front surface of the intermediate transfer belt 16. The cleaning auxiliary roller 22 disposed inside the loop of the intermediate transfer belt 16 supports the intermediate transfer belt 16 from inside the loop so that the residual toner on the intermediate transfer belt 16 is removed reliably by the belt cleaning device 21.

The fixing device 34 includes a fixing roller 34*a* and a pressing roller 34*b*. The fixing roller 34*a* includes a heat source such as a halogen lamp inside thereof. While rotating, the pressing roller 34*b* pressingly contacts the fixing roller 34*a*, thereby forming a heated area called a fixing nip therebetween. The recording medium P bearing an unfixed toner image on the surface thereof delivered to the fixing device 34 is interposed between the fixing roller 34*a* and the pressing roller 34*b* at the fixing nip, and contacts tightly the fixing roller 34*a*. Under heat and pressure in the fixing nip, the toner adhered to the unfixed toner image is softened and fixed to the recording medium P.

Subsequently, the recording medium P output from the fixing device 34 is discharged outside the image forming apparatus along a sheet path 35 after the fixing process.

In the case of a single-side print mode instructed by an input device such as a key pad and an operation panel of the image forming apparatus, or a control signal from an external device such as a PC, the recording medium P interposed between a pair of sheet output rollers 36 is output onto an upper surface of a top cover 50 of the housing 90 of the image forming apparatus.

By contrast, in a duplex printing mode, as the trailing edge of the recording medium P interposed between the sheet output rollers 36 passes through the sheet path 35 after fixing, the end of the sheet path 35 is closed by a switching claw. Substantially at the same time, the pair of the sheet output rollers 36 starts to rotate in the opposite direction. The recording medium P is delivered to a sheet path 400 with the trailing edge of the recording medium P facing the front.

As the pair of the sheet discharge rollers 36 rotates in the opposite direction, the recording medium P enters the sheet path 400 and is delivered vertically from the upper side of the image forming apparatus to the lower side, and then to a sheet reversing path 44 which is curved in a half circle. As the recording medium P is delivered along the curve of the sheet reversing path 44, the recording medium P is reversed and the delivery direction (from the top to the bottom) is reversed. That is, the recording medium P is delivered from the lower portion of the image forming apparatus to the upper portion. Subsequently, the recording medium P enters again to the secondary transfer nip via the sheet path 31. A full-color image is secondarily transferred onto the other side of the recording medium. Then, the recording medium P passes through the post-transfer sheet path 33, the fixing device 34, the post-fixing sheet path 35, and the pair of the sheet output rollers 36, accordingly. Lastly, the recording medium P is discharged outside the image forming apparatus.

The top cover 50 of the image forming apparatus is pivotally held by a shaft 51. As the top cover 50 rotates about the shaft 51 in the counterclockwise direction, the upper portion of the housing 90 of the image forming apparatus is opened widely, allowing the upper portion thereof to be accessible.

The toner cartridges 13Y, 13M, 13C, and 13K, and the writing heads 70Y, 70M, 70C, and 70K are held by a middle cover 40 serving as a holder. The middle cover 40 is also pivotally held about the shaft 51. As the middle cover 40 rotates in the counterclockwise direction, the housing 90 is opened, allowing the image forming units 1Y, 1M, 1C, and 1K in the housing 90 to be accessible.

The toner cartridges 13Y, 13M, 13C, and 13K can be replaced with the top cover 50 opened. The image forming units 1Y, 1M, 1C, and 1K can be replaced with the top cover 50 and the middle cover 40 opened.

According to the present illustrative embodiment, the fulcrum of the middle cover 40 and the top cover 50 is at the end portion of the opposite side of the sheet delivery path (on the right-hand side in FIG. 1). In a case in which the fulcrum of the top cover 50 and the middle cover 40 is at a position Z on the right-hand side of FIG. 1, the image forming unit 1K is not fully accessible when the top cover 50 and the middle cover 40 are opened unless the top cover 50 and the middle cover 40 extend to the end of the other side of the fulcrum, that is, the opposite side of Z. In this case, the middle cover 40 is long in the horizontal direction (left-right) in FIG. 1, increasing the cost of parts.

When delivering the recording medium P vertically as in the present illustrative embodiment, the middle cover 40 and the post-fixing sheet path 35 overlap as viewed in a direction perpendicular to the sheet delivery direction (vertical direction) and parallel to the recording medium P. As a result, if paper jams occur in the post-fixing sheet path 35, the middle cover 40 may hinder removal of the jammed paper. The middle cover 40 needs to be disposed so as not to interfere with the post-fixing sheet path 35 and so forth, complicating the configuration of the middle cover 40 and hence complicating efforts to make the image forming apparatus at low cost. Furthermore, the horizontally-long top cover 50 and middle cover 40 requires a relatively large space at the upper portion of the image forming apparatus to allow the top cover 50 and the middle cover 40 to be opened.

By contrast, as in the present illustrative embodiment, providing the fulcrum (shaft 51) of the top cover 50 and the middle cover 40 substantially at the end of the other side of the sheet delivery side (the right side in FIG. 1) enables the image forming units 1Y, 1M, 1C, and 1K to be uncovered without extending the length of the top cover 50 and the middle cover 40 to the sheet delivery side when the top cover 50 and the middle cover 40 are opened. With this configuration, the length of the top cover 50 and the middle cover 40 can be reduced, thereby reducing the cost of parts. Furthermore, the space required for opening the top cover 50 and the middle cover 40 can be reduced as compared with providing the fulcrum at the sheet delivery side (i.e., at the position Z). Even when paper jams occur in the post-fixing sheet path 35, the middle cover 40 does not hider removal of the jammed paper. It is not necessary to dispose the middle cover 40 so as not to interfere with the post-fixing sheet path 35. Accordingly, the configuration of the middle cover 40 can be simple and the cost of parts can be reduced.

Figure 3:
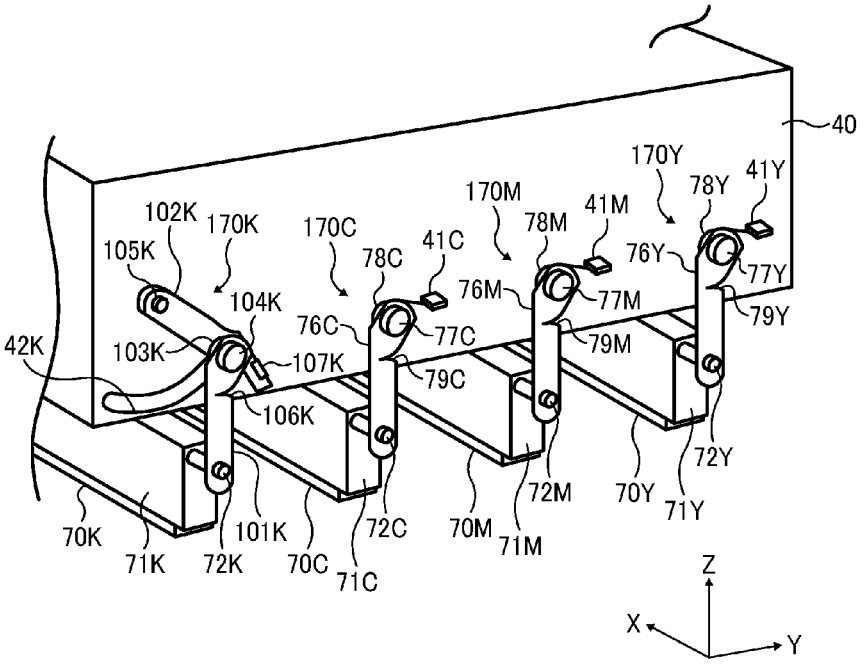
FIG. 3 is a perspective view schematically illustrating a middle cover of the image forming apparatus according to an illustrative embodiment of the present invention.
Figure 4:
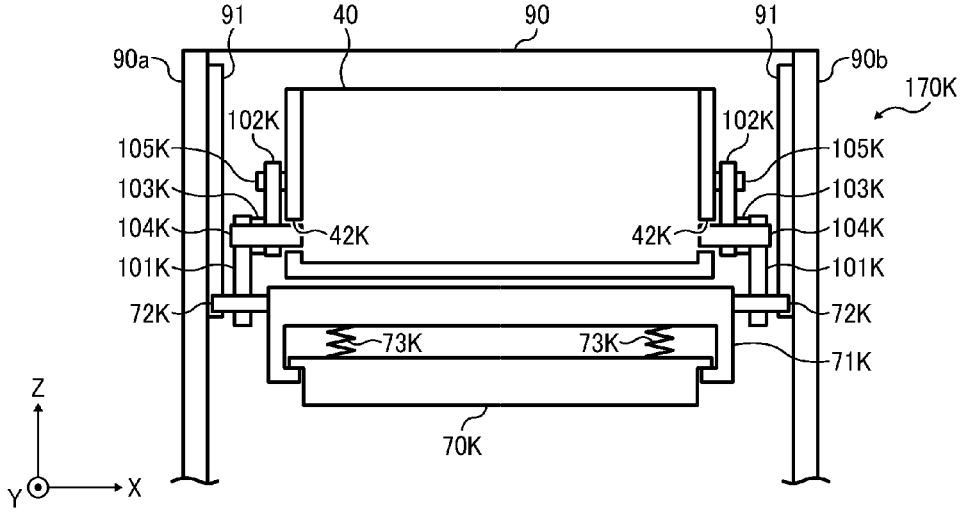
FIG. 4 is a schematic diagram illustrating a moving device for the color yellow according to an illustrative embodiment of the present invention.
Figure 5:
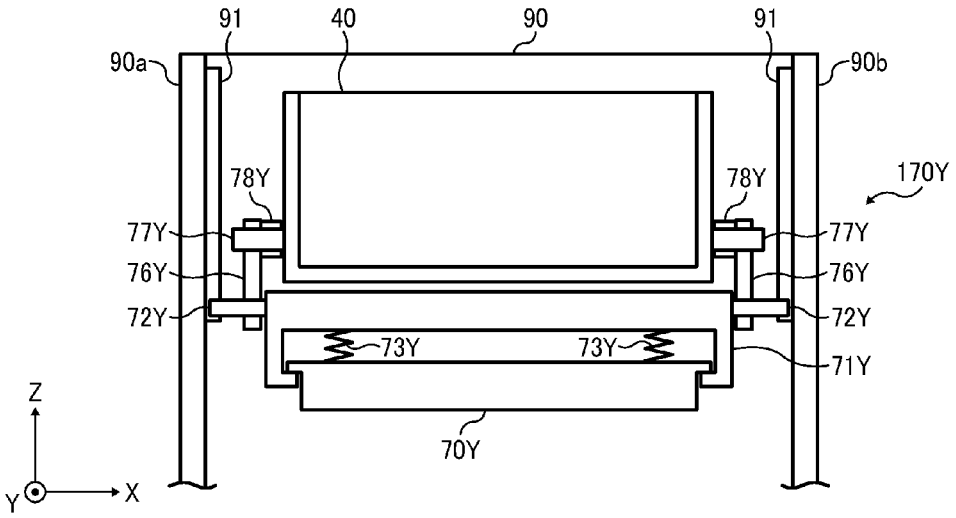
FIG. 5 is a schematic diagram illustrating a moving device for the color black according to an illustrative embodiment of the present invention.

With reference to FIGS. 3 through 5, a description is provided of the middle cover 40 to hold the writing heads 70Y, 70M, 70C, and 70K. FIG. 3 is a perspective view schematically illustrating the middle cover 40 according to an illustrative embodiment of the present invention. FIG. 4 is a schematic diagram illustrating a moving device 170K for the color black according to an illustrative embodiment of the present invention. FIG. 5 is a schematic diagram illustrating a moving device 170Y for the color yellow as a representative example of moving devices 170Y, 170M, and 170C.

Each of the writing heads 70Y, 70M, 70C, and 70K is swingably held relative to the middle cover 40 by moving devices 170Y, 170M, 170C, and 170K, respectively. Among the writing heads 70Y, 70M, 70C, and 70K, the writing head 70K for the color black is closest to the fulcrum or the shaft 51 of the middle cover 40. The moving device 170K that swingably holds the writing head 70K relative to the middle cover 40 has a different configuration from other moving devices 170Y, 170M, and 170C while the moving devices 170Y, 170M, and 170C have the same configuration. The writing heads 70Y, 70M, 70C, and 70K are held by head holder 71Y, 71M, 71C, and 71K, respectively. As illustrated in FIGS. 4 and 5, the writing heads 70K and 70Y are biased against the photosensitive drums 2K and 2Y by springs 73K and 73Y.

With reference to FIG. 3, a description is provided of the moving devices 170Y, 170M, and 170C. As illustrated in FIG. 3, the moving devices 170Y, 170M, and 170C include arms 76Y, 76M, and 76C, torsion springs 78Y, 78M, and 78C serving as biasing members, respectively. First rotary members 72Y, 72M, and 72C extending from the head holders 71Y, 71M, and 71C are rotatably attached to an end of each of the respective arms 76Y, 76M, and 76C. Second rotary members 77Y, 77M, and 77C disposed on the surface of the middle cover 40 are attached to the other end of the respective arms 76Y, 76M, and 76C.

The torsion springs 78Y, 78M, and 78C are interposed between the middle cover 40 and the arms 76Y, 76M, and 76C, and held by the second rotary members 77Y, 77M, and 77C, respectively. One end of each of the torsion springs 78Y, 78M, and 78C contacts respective spring bearings 41Y, 41M, and 41C. The other end of each of the torsion springs 78Y, 78M, and 78C is hooked to respective hooks 79Y, 79M, and 79C. Accordingly, the arms 76Y, 76M, and 76C are biased toward the shaft 51 by the torsion springs 78Y, 78M, and 78C, respectively.

The middle cover 40 includes restriction members that restrict movement of the arms 76Y, 76M, and 76C biased by the torsion springs 78Y, 78M, and 78C when the arms 76Y, 76M, and 76C swingably move at a certain angle. More specifically, when the arms 76Y, 76M, and 76C swingably move at a certain angle, the restriction members contact the arms 76Y, 76M, and 76C to stop the arms 76Y, 76M, and 76C.

Still referring to FIG. 3, a description is now provided of the moving device 170K. The moving device 170K closest to the fulcrum side (the shaft 51 side) among the moving devices 170 includes a first arm 101K, a second arm 102K, a torsion spring 103K serving as a biasing member, and so forth. The first arm 101K has a similar configuration as the arms 76Y, 76M, and 76C. A first rotary member 72K extending from the head holder 71K is rotatably attached to an end of the first arm 101K. The other end of the first arm 101K is rotatably attached to a second rotary member 104K fixed near the center of the second arm 102K. One end of the second arm 102K is rotatably attached to a third rotary member 105K disposed on the lateral surface of the middle cover 40, and the other end of the second arm 102K is provided with a spring seat 107K.

The torsion spring 103K is interposed between the first arm 101K and the second arm 102K, and held by the second rotary member 104K. One end of the torsion spring 103K contacts the spring seat 107K provided to the second arm 102K. The other end of the torsion spring 103K is hooked to a spring support portion or a notch 106K of the first arm 101K. In this configuration, the first arm 101K is biased by the torsion spring 103K toward the shaft 51. The second arm 102K includes a restriction member that restricts movement of the first arm 101K biased by the torsion spring 103K when the first arm 101K swingably moves at a certain angle. More specifically, when the first arm 101K swingably moves at a certain angle, the restriction member contacts the first arm 101K to stop.

As illustrated in FIGS. 3 and 4, the middle cover 40 includes a guide hole 42K having a curved shape similar to a half circle. The second rotary member 104K penetrates through the second arm 102K and the guide hole 42K.

Figure 6:
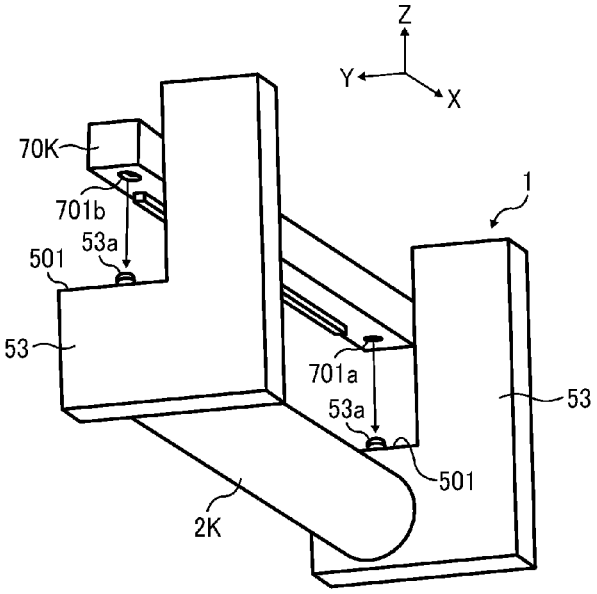
FIG. 6 is a schematic diagram illustrating a positioning mechanism for positioning a writing head in place relative to a photosensitive drum.

With reference to FIG. 6, a description is provided of positioning of the writing head 70K relative to the photosensitive drum 2K. FIG. 6 is a schematic diagram illustrating a positioning mechanism for positioning the writing head 70K in place relative to the photosensitive drum 2K. It is to be noted that the positioning mechanism for the writing heads 70Y, 70M, and 70C for the colors yellow, magenta, and cyan, respectively, is similar to the positioning mechanism for the writing heads 70K.

As illustrated in FIG. 6, a housing 53 of the image forming unit 1K includes projections 53*a*. The writing head 70K includes positioning holes 701*a* and 701*b* at both ends of the writing head 70K in the longitudinal direction thereof facing the photosensitive drum 2K. The longitudinal direction of the writing head 70K coincides with the axial direction of the photosensitive drum 2K indicated by an arrow X. The positioning hole 701*a* provided at the distal side in FIG. 6 is a round hole having substantially the same diameter as the projection 53*a* and serves as a reference hole. By contrast, the positioning hole 701*b* at the proximal side is an elongate hole extending in the longitudinal direction and serves as a sub-reference hole.

The projections 53*a* of the housing 53 are inserted to the positioning holes 701*a* and 701*b*, thereby positioning the writing head 70K in place relative to the photosensitive drum 2K in the direction X and around the directions Z and X. The projections 53*a* are provided to a surface 501 of the housing 53. As the writing head 70K facing the photosensitive drum 2K contacts the surface 501 of the housing 53, the writing head 70K is positioned in place in the direction Z, and around the direction Y. With this configuration, the relative positions of the photosensitive drum 2K and the writing head 70K are reliably maintained, thereby forming a desired latent image.

Figure 7:
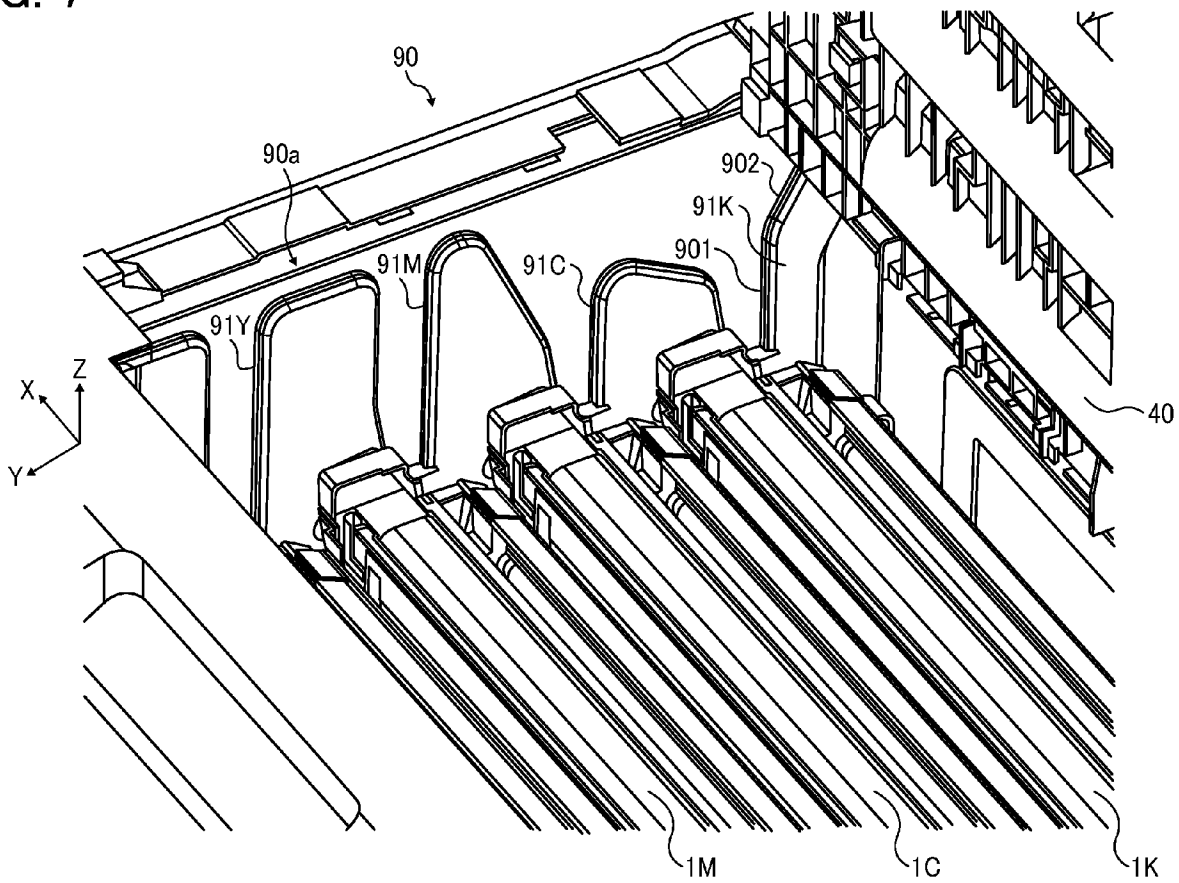
FIG. 7 is a perspective view schematically illustrating an internal configuration of a cover.

FIG. 7 is a perspective view schematically illustrating an interior configuration of the housing 90 of the image forming apparatus. FIG. 7 shows one side of the housing 90 in the longitudinal direction.

As illustrated in FIG. 7, the housing 90 is made of metal planar members including lateral plates 90*a* and 90*b* (also shown in FIGS. 4 and 5). The lateral plates 90*a* and 90*b* include guide members 91Y, 91M, 91C, and 91K that guide the writing heads 70Y, 70M, 70C, and 70K in the housing 90. The guide members 91Y, 91M, 91C, and 91K are formed through a drawing process in which portions of the lateral plates 90*a* and 90*b* made of metal planar members are drawn to project inside the housing 90.

When moving each of the writing heads 70Y, 70M, 70C, and 70K between a retracted position at which the writing heads 70Y, 70M, 70C, and 70K are separated from the latent image bearing members and an engaged position at which the writing heads 70Y, 70M, 70C, and 70K write latent images by pivotally moving the middle cover 40, the first rotary members 72Y, 72M, 72C, and 72K projecting from the arms 76Y, 76M, and 76C, and the first arm 101K, respectively, contact the guide members 91Y, 91M, 91C, and 91K, thereby guiding reliably the writing heads 70Y, 70M, 70C, and 70K in the housing 90.

The guide members 91Y, 91M, and 91C extend linearly and vertically (in the direction Z) relative to the image forming units 1Y, 1M, and 1C. With this configuration, the writing heads 70Y, 70M, and 70C move linearly in the direction Z in the housing 90, and the positioning holes 701*a* and 701*b* of the writing heads 70Y, 70M, and 70C are fitted with and disengaged from the projections 53*a* of the image forming units 1Y, 1M, and 1C.

The guide member 91K includes a linear portion 901 having a linear shape in the vertical direction (in the direction Z) and an oblique portion 902 extending obliquely toward the shaft 51. After the writing head 70K is guided linearly in the vertical direction (in the direction Z) by the linear portion 901, the writing head 70K is guided by the oblique portion 902 to the shaft 51. In this case, near the engaged position, the writing head 70K moves linearly in the housing 90 in the vertical direction (in the direction Z). Accordingly, the positioning holes 701*a* and 701*b* of the writing head 70K are smoothly fitted with and disengaged from the projections 53*a* of the image forming unit 1K.

In a case in which the writing heads 70Y, 70M, 70C, and 70K are at the engaged position, the arms 76Y, 76M, and 76C, and the first arm 101K are biased toward the guide members 91Y, 91M, 91C, and 91K by the torsion springs 78Y, 78M, 78C, and 103K, respectively, thereby pressing the first rotary members 72Y, 72M, 72C, and 72K against the guide members 91Y, 91M, 91C, and 91K.

Figure 9:
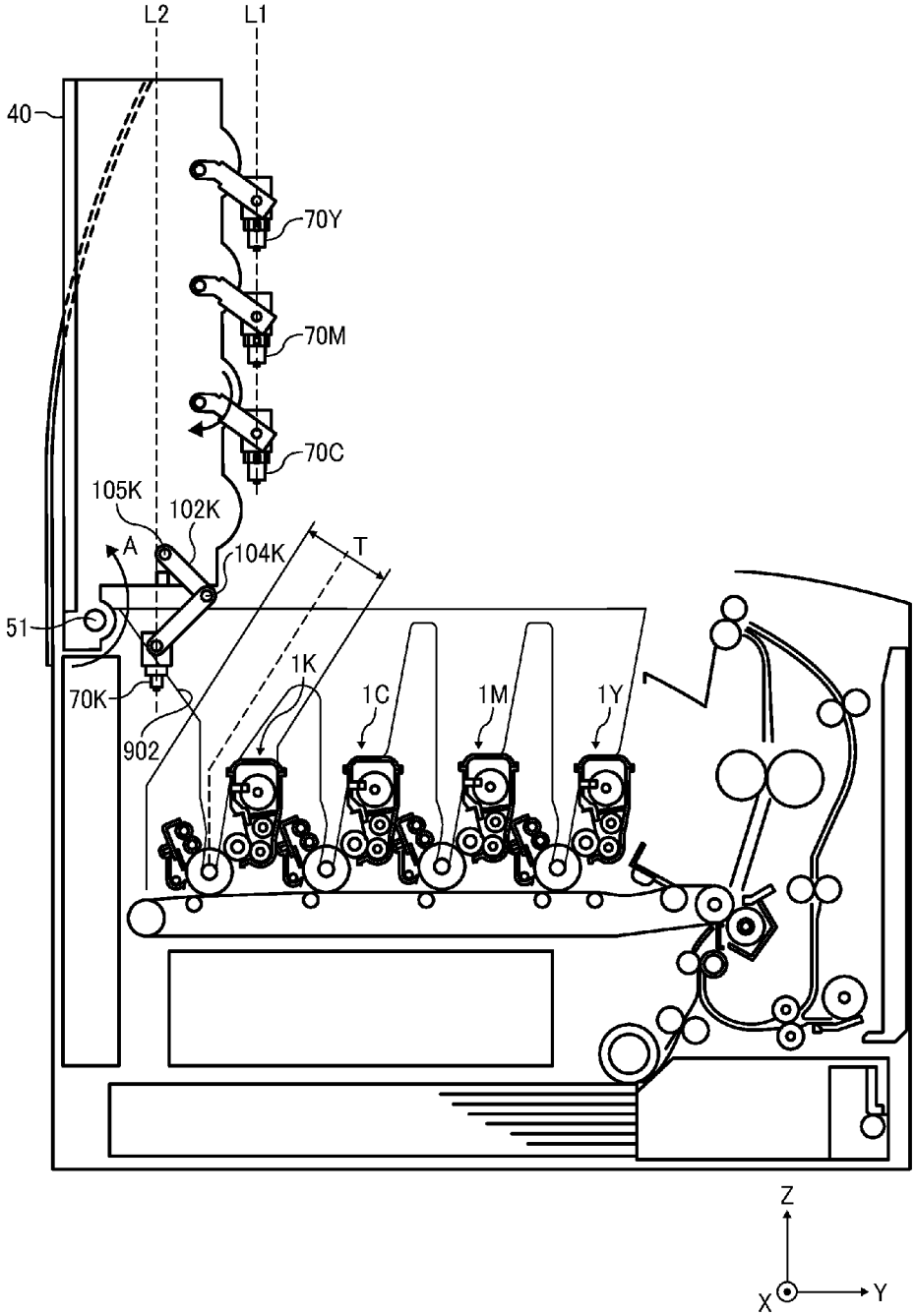
FIG. 9 is a schematic diagram illustrating the middle cover rotated 90 degrees to open the housing.

With reference FIGS. 8 and 9, a description is provided of movement of the writing heads 70Y, 70M, 70C, and 70K. FIG. 8 is a schematic diagram illustrating the image forming apparatus in the state in which the middle cover 40 starts to open (rotated approximately 15 degrees). FIG. 9 is a schematic diagram illustrating the middle cover 40 rotated approximately 90 degrees in the direction indicated by an arrow A.

After the top cover 50 is opened from the state shown in FIG. 1 and the middle cover 40 starts to open, each of the writing heads 70Y, 70M, 70C, and 70K at the engaged position starts to move to the retracted position by the middle cover 40.

First, a description is provided of movement of the writing heads 70Y, 70M, and 70C. The second rotary members 77Y, 77M, and 77C fixed to the middle cover 40 move such that the trajectory of the second rotary members 77Y, 77M, and 77C is an arc of a circle with the shaft 51 at the center. The shaft 51 serves as a fulcrum of the middle cover 40. In this configuration, the second rotary members 77Y, 77M, and 77C move also to the right until the second rotary members 77Y, 77M, and 77C reach the same height as the shaft 51. As a result, while the writing heads 70Y, 70M, and 70C move in the housing 90, the second rotary members 77Y, 77M, and 77C move also to the right. The arms 76Y, 76M, and 76C are rotatably supported relative to the second rotary members 77Y, 77M, and 77C, and biased toward the left side in FIG. 8 by the torsion springs 78Y, 78M, and 78C (shown in FIG. 3). Thus, as the second rotary members 77Y, 77M, and 77C move to the right, the arms 76Y, 76M, and 76C pivotally move in the direction indicated by an arrow B in FIG. 8. Accordingly, the first rotary members 72Y, 72M, and 72C are guided and moved linearly by the guide members 91Y, 91M, and 91C extending linearly in the vertical direction.

The first rotary members 72Y, 72M, and 72C are rotatable relative to the arms 76Y, 76C, and 76M. When the arms 76Y, 76M, and 76C swingably move in the direction of arrow B in FIG. 8, the writing heads 70Y, 70M, and 70C swingably move in the direction of arrow C, thereby keeping the plane of the writing heads 70Y, 70M, and 70C, which faces the photosensitive drums, perpendicular to the vertical direction. With this configuration, when the writing heads 70Y, 70M, and 70C move from the engaged position to the retracted position, the projections 53*a* shown in FIG. 6 are disengaged from the positioning holes 701*a* and 701*b* smoothly. Furthermore, the writing heads 70Y, 70M, and 70C move linearly in the vertical direction (the direction Z) in the housing 90, thereby allowing the developing device 5K to be disposed near the writing heads 70Y, 70M, and 70C. Even when the developing device 5K is disposed near the writing heads 70Y, 70M, and 70C, the developing device 5K does not interfere with movement of the writing heads 70Y, 70M, and 70C when moving the writing heads 70Y, 70M, and 70C. With this configuration, the downsizing of the image forming apparatus can be achieved.

The arms 76Y, 76M, and 76C are biased toward the guide members 91Y, 91M, and 91C by the torsion springs 78Y, 78M, and 78C, thereby pressing the first rotary members 72Y, 72M, and 72C against the guide members 91Y, 91M, and 91C. With this configuration, even when the middle cover 40 and the like vibrate or stress is applied thereto while moving the writing heads 70Y, 70M, and 70C, the arms 76Y, 76M, and 76C do not easily move in the housing 90, thereby preventing the writing heads 70Y, 70M, and 70C from contacting other components in the housing. The writing heads 70Y, 70M, and 70C are prevented from getting damaged.

As the middle cover 40 is pivotally moved further and the first rotary members 72Y, 72M, and 72C separate from the guide members 91Y, 91M, and 91C, the arms 76Y, 76M, and 76C come into contact with the restriction member, thereby restricting movement of the arms 76Y, 76M, and 76C in the direction of arrow B. After the first rotary members 72Y, 72M, and 72C separate from the guide members 91Y, 91M, and 91C, the arms 76Y, 76M, and 76C are pressed against the restriction member by the torsion springs 78Y, 78M, and 78C. With this configuration, even after the first rotary members 72Y, 72M, and 72C separate from the guide members 91Y, 91M, and 91C, the arms 76Y, 76M, and 76C are prevented from moving due to vibration and stress applied thereto, hence preventing the writing heads 70Y, 70M, and 70C from contacting the bottom surface of the middle cover 40 and getting damaged. Furthermore, because the first rotary members 72Y, 72M, and 72C do not move easily when moving the writing heads 70Y, 70M, and 70C from the retracted position to the engaged position, the first rotary members 72Y, 72M, and 72C can reliably contact the guide members 91Y, 91M, and 91C.

As the first rotary members 72Y, 72M, and 72C separate from the guide members 91Y, 91M, and 91C, and the arms 76Y, 76M, and 76C contact the restriction member so that movement thereof in the direction of arrow B is restricted, the writing heads 70Y, 70M, and 70C swingably move in the direction opposite the direction of arrow C as illustrated in FIG. 8 in conjunction with movement of the middle cover 40 in the direction of arrow A, thereby keeping the plane of the writing heads 70Y, 70M, and 70C, which face the photosensitive drums 2, perpendicular to the vertical direction (the direction Z). With this configuration, even when the writing heads 70Y, 70M, and 70C are at the retracted position as illustrated in FIG. 9, the plane of the writing heads 70Y, 70M, and 70C facing the photosensitive drums 2 is kept facing vertically downward, thereby preventing lenses disposed on the plane of the writing heads 70Y, 70M, and 70C facing the photosensitive drums 2 from getting contaminated upon replacement of the image forming units 1Y, 1M, 1C, and 1K.

When closing the middle cover 40 to move the writing heads 70Y, 70M, and 70C from the retracted position to the engaged position, the arms 76Y, 76M, and 76C are pressed against the restriction member, thereby moving the first rotary members 72Y, 72M, and 72C while contacting guide members 91Y, 91M, and 91C. The first rotary members 72Y, 72M, and 72C contact reliably the guide members 91Y, 91M, and 91C. The middle cover 40 is closed further from the state in which the first rotary members 72Y, 72M, and 72C contact the guide members 91Y, 91M, and 91C, the first rotary members 72Y, 72M, and 72C are pushed toward the guide members 91Y, 91M, and 91C. Subsequently, while the arms 76Y, 76M, and 76C swingably move in the direction opposite the direction of arrow B shown in FIG. 8 against the force of the torsion springs 78Y, 78M, and 78C due to reaction force of the guide members 91Y, 91M, and 91C, the first rotary members 72Y, 72M, and 72C are guided and moved linearly in the vertical direction by the guide members 91Y, 91M, and 91C. Accordingly, the writing heads 70Y, 70M, and 70C move down in the vertical direction in the housing 90, enabling the projections 53*a* to be fitted to the positioning holes 701*a* and 701*b*.

Next, with reference to FIGS. 3, 8 and 9 a description is provided of movement of the writing head 70K according to an illustrative embodiment of the present invention. When the writing head 70K is at the engaged position, the first arm 101K is biased in the direction of arrow B by the torsion spring 103K shown in FIG. 3, and the first rotary member 72K contacts the linear portion 901 of the guide member 91K. The second rotary member 104K contacts an end portion of the guide hole 42K (shown in FIG. 3) opposite the shaft 51.

When moving the middle cover 40 in the direction of arrow A, that is, opening the middle cover 40 from the closed position, so as to move the writing head 70K from the engaged position to the retracted position, the third rotary member 105K fixed to the middle cover 40 moves such that the trajectory of the third rotary member 105K is an arc of a circle with the shaft 51 at the center. The shaft 51 serves as a fulcrum of the middle cover 40. As a result, while the writing head 70K moves in the housing 90, the third rotary member 105K moves to the right. As the third rotary member 105K moves to the right, the first arm 101K swingably moves in the direction of arrow B due to the force of the torsion spring 103K. Accordingly, the first rotary member 72K disposed substantially at the bottom end of the first arm 101K is pressed against and guided by linear potion 901 of the guide member 91K extending linearly in the vertical direction.

The second rotary member 104K disposed substantially at the upper end of the first arm 101K, which is the opposite end of the first arm 101K with the first rotary member 72K, is biased against the opposite side of the shaft 51 by the torsion spring 103K, thereby keeping the second rotary member 104K in contact with the end of the guide hole 42K at the opposite side of the shaft 51. With this configuration, even when the middle cover 40 and the like vibrate or stress is applied thereto while moving the writing head 70K, the first arm 101K does not easily move in the housing 90, thereby preventing the writing head 70K from contacting other components in the housing 90 and getting damaged.

The first rotary member 72K is rotatable relative to the first arm 101K. When the first arm 101K rotatably moves in the housing 90 in the direction of arrow B in FIG. 8, the writing head 70K swingably moves in the direction of arrow C, thereby keeping the plane of the writing head 70K, which faces the photosensitive drum 2K, perpendicular to the vertical direction. With this configuration, when the writing head 70K moves from the engaged position to the retracted position, the projections 53*a* shown in FIG. 6 are disengaged from the positioning holes 701*a* and 701*b* smoothly. Furthermore, the writing head 70K moves linearly in the vertical direction (the direction Z) in the housing 90, thereby allowing the developing device 5K to be disposed near the writing head 70K. Even when the developing device 5K is disposed near the writing head 70K, the developing device 5K does not interfere with movement of the writing head 70K when moving the writing head 70K. With this configuration, the downsizing of the image forming apparatus can be achieved.

As the middle cover 40 is moved and the first rotary member 72K is guided near the upper end portion of the linear portion 901 of the guide member 91, that is, the connecting portion between the linear portion 901 and the oblique portion 902, the first arm 101K comes into contact with the restriction member, thereby restricting movement of the first arm 101K in the direction of arrow B. As the middle cover 40 continues to open further, the second rotary member 104K moves in the guide hole 42K toward the shaft 51 under the weight of the writing head 70K and so forth. In this configuration, the second arm 102K swingably moves about the third rotary member 105K as the fulcrum in the direction of arrow D in FIG. 8, and the first rotary member 72K continuously moves along the linear portion 901 of the guide member 91.

As for the color black, the third rotary member 105K fixed to the middle cover 40 moves such that the trajectory thereof is an arc of a circle with the shaft 51 at the center. The shaft 51 serves as a fulcrum of the middle cover 40. Because the third rotary member 105K is close to the shaft 51, an amount of movement of the third rotary member 105K to the right while the writing head 70K for the color black moves in the housing 90 is more than the second rotary members 77Y, 77M, and 77C.

Figure 10A:
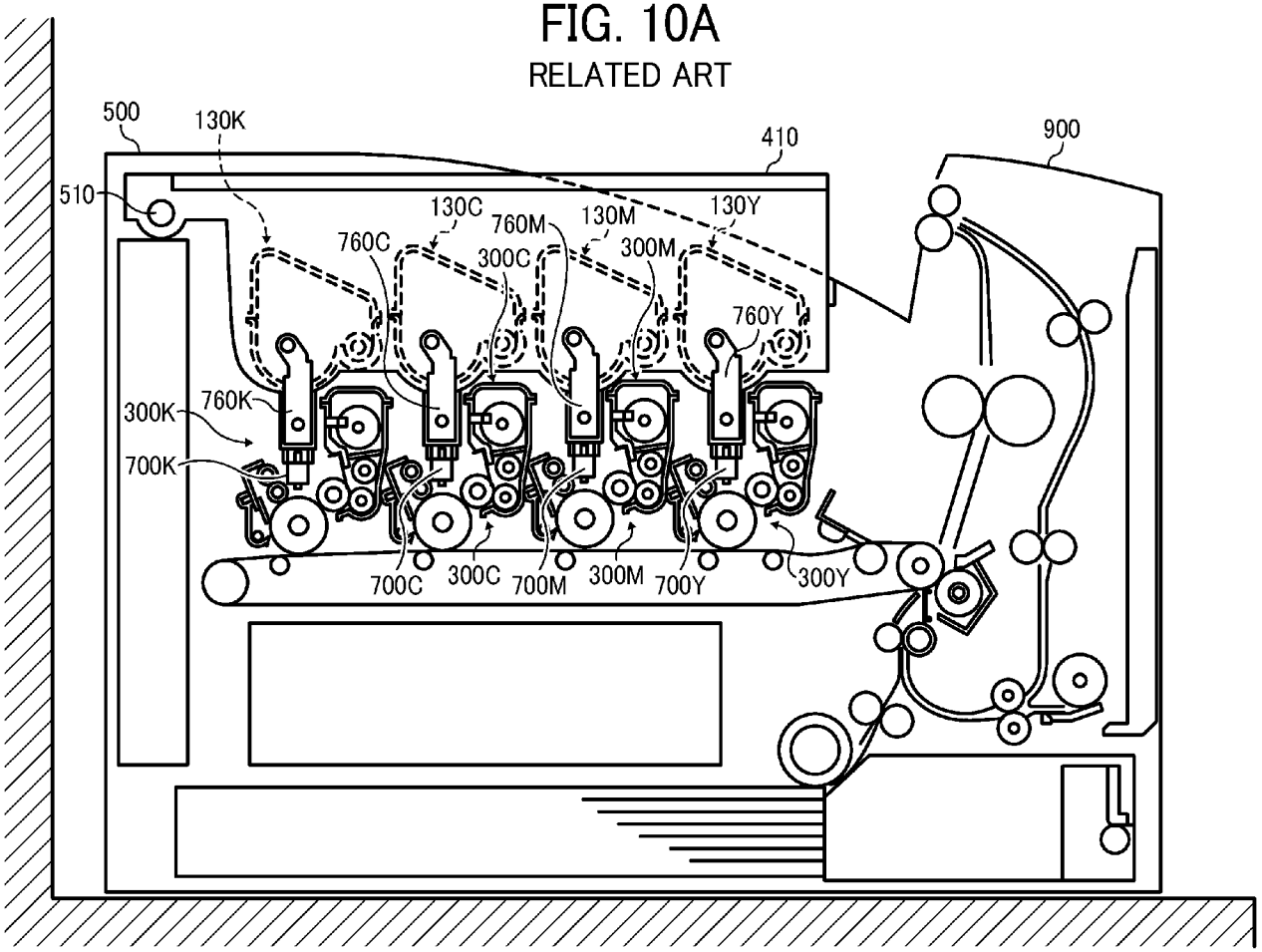
FIG. 10A RELATED ART
FIG. 10A is a schematic diagram illustrating a related-art image forming apparatus with a top cover closed.
Figure 10B:
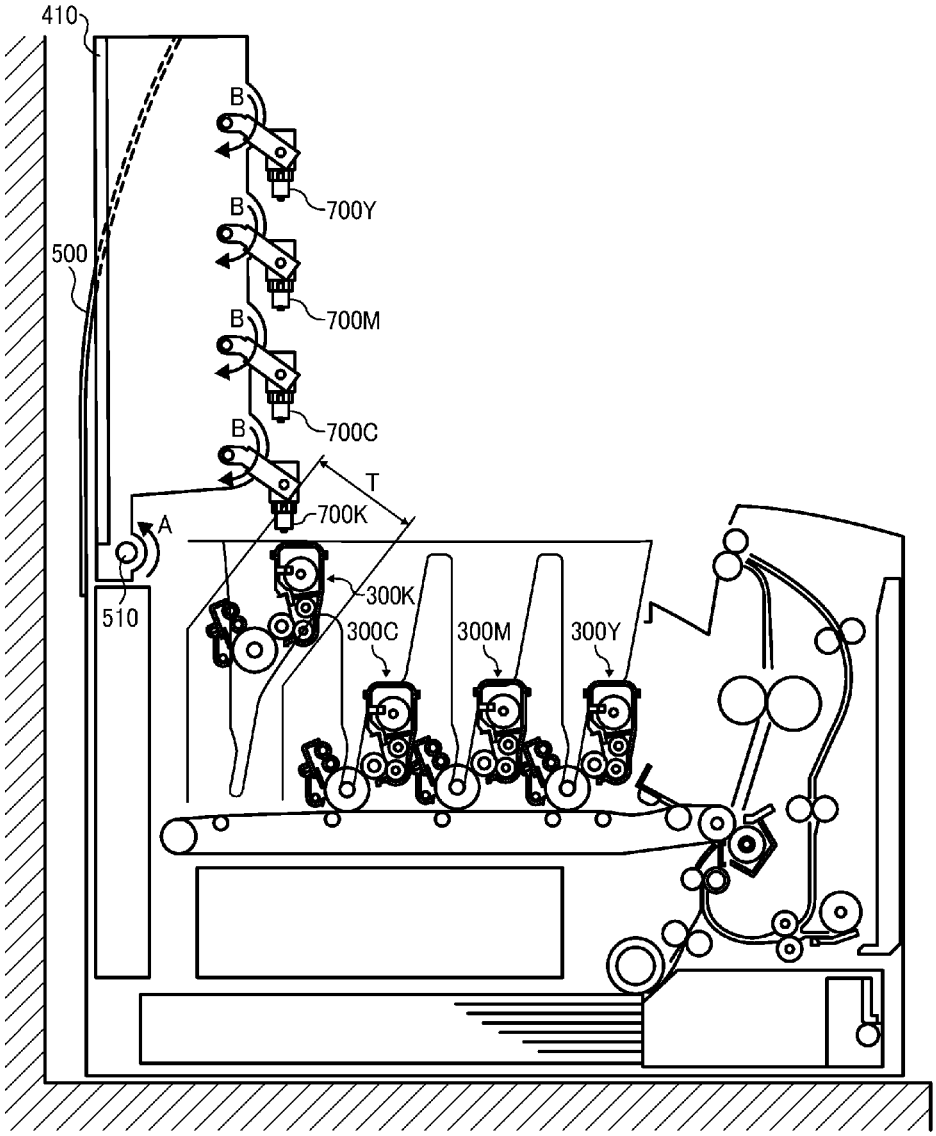
FIG. 10B RELATED ART
FIG. 10B is a schematic diagram illustrating the related-art image forming apparatus with the top cover opened.

As described above with reference to FIGS. 10A and 10B, if the moving mechanism for the color black has the same configuration as that of the moving mechanisms of other colors yellow, magenta, and cyan, and a range of movement of the writing head 700K relative to the middle cover 410 is the same as the range of movement of the writing heads 700Y, 700M, and 700C, the writing head 700K contacts the restriction member before the writing head 700K is removed from the housing 900. As a result, the writing head 700K cannot move to the right and linearly move in the vertical direction in the housing 900. Thus, the developing device for the black color cannot be disposed near the writing head 700K, thereby complicating efforts to make the image forming apparatus as a whole as compact as is usually desired.

By contrast, according to the present illustrative embodiment, as described above, after the first arm 101K is restricted by the restriction member, the second arm 102K moves in the direction of arrow D shown in FIG. 8, thereby moving the writing head 70K to the left relative to the middle cover 40. With this configuration, even after movement of the first arm 101K is restricted, the first rotary member 72 moves along the linear portion 901 of the guide member 91, enabling the writing head 70K to move linearly upward in the vertical direction in the housing 90 and allowing the developing device 5K to be disposed near the writing head 70K. The size of the image forming apparatus can be reduced.

As the middle cover 40 is opened further, the second arm 102K swingably moves in the direction of arrow D about the third rotary member 105K as the fulcrum, thereby moving the first rotary member 72K from the linear portion 901 to the oblique portion 902 of the guide member 91 and hence moving the writing head 70K to the shaft 51.

As the middle cover 40 is moved in the direction of arrow A to open the middle cover 40, the angle of the guide hole 42 becomes steep. In a case in which the guide member 91 includes only the linear portion 901, when the first rotary member 72K separates from the linear portion 901, the second arm 102K rotates fast in the direction of arrow D under its own weight, causing the second rotary member 104K to strike the end of the guide hole 42K at the shaft 51 side, damaging the second rotary member 104K. By contrast, providing the oblique portion 902 as in the present illustrative embodiment, the second arm 102K is prevented from moving fast in the direction of arrow D under its own weight. Accordingly, the writing head 70K is moved gradually toward the shaft 51 in conjunction with opening of the middle cover 40, hence preventing the second rotary member 104K from getting damaged.

As the middle cover 40 is fully opened, the second arm 104K contacts the end of the guide hole 42K at the shaft 51 side, thereby restricting movement of the second arm 102K in the direction of arrow D.

As described above, according to the present illustrative embodiment, the moving device 170K includes the first arm 101K for holding the writing head 70K (via the head holder 71K), and the second arm 102K for rotatably supporting the first arm 101K and movably supported by the middle cover 40. With this configuration, the first arm 101K can swingably move relative to the second arm 102K upon moving the writing head 70K from the engaged position, thereby moving the writing head 70K linearly. By moving the second arm 102K about the third rotary member 105K after the writing head 70K is moved linearly in the direction of arrow D to some extend, the writing head 70K is retracted toward the shaft 51.

As illustrated in FIG. 9, when the middle cover 40 is opened 90 degrees so as to move the writing heads 70Y, 70M, 70C, and 70K to the retracted position, the writing head 70K closest to the shaft 51 serving as the fulcrum of the middle cover 40 is positioned closest to an end of the housing 90 (at the shaft 51 side), as compared with other writing heads 70Y, 70M, and 70C. With this configuration, even when there is a wall next to the image forming apparatus at the shaft 51 side (the left hand side in FIG. 9) and/or there is an object higher than the image forming apparatus so that the middle cover 40 cannot be opened more than 90 degrees, the writing head 70K is positioned at the retracted position outside an area T which is an area in which the image forming unit 1K passes upon removal of the image forming unit 1K from the image forming apparatus.

According to the present illustrative embodiment, when removing the image forming unit 1K from the housing 90 by opening the middle cover 40, the writing head 70K does not interfere with the operation, thereby allowing the image forming unit 1K to be removed from the housing 90 with ease. Furthermore, when removing the image forming unit 1K, the writing head 70K is prevented from contacting the image forming unit 1K, hence preventing damage to the writing head 70K.

When the middle cover 40 is opened approximately 90 degrees, the writing head 70K is positioned closer to an end portion of the housing 90 (at the shaft 51 side) than from the third rotary member 105K serving as the fulcrum of the second arm 102K. With this configuration, the writing head 70K is separated from the area T when the image forming unit 1K is removed from the housing 90, which reliably prevents the writing head 70K from contacting the image forming unit 1K.

When the writing head 70K is at the retracted position, the second rotary member 104K contacts the end portion of the guide hole 42K at the shaft 51 side and the first rotary member 72K contacts the oblique portion 902. Accordingly, the clockwise rotation of the second arm 102K as shown in FIG. 9 is prevented when the writing head 70K is at the retracted position. This prevents the writing head 70K from moving toward the shaft 51 and contacting the shaft 51. The writing head 70K is prevented from getting damaged even when the image forming apparatus vibrates or some stress is applied thereto.

According to the present illustrative embodiment, when the middle cover 40 holding the writing heads 70Y, 70M, 70C, and 70K is opened, at least one of the writing heads 70Y, 70M, 70C, and 70K, closest to the fulcrum of the middle cover 40, in this example, the writing head 70K, is positioned on a line L2 which is closer to the end portion of the housing 90 pivotally holding the middle cover 40 than from a line L1 which is a line connecting the writing heads 70Y, 70M, and 70C as viewed from the axial direction of the latent image bearing members 2.

According to the present illustrative embodiment, the configuration of the moving devices 170Y, 170M, and 170C is not the same as that of the moving device 170K, which means that the amount of movement of the writing heads 70Y, 70M, and 70C relative to the middle cover 40 is not the same as that of the writing head 70K closest to the shaft 51. If the amount of movement of the writing heads 70Y, 70M, and 70C is the same as that of the writing head 70K and the writing heads 70Y, 70M, and 70C are retracted to the same position as the writing head 70K, upon closure of the middle cover 40, the first rotary members 72Y, 72M, and 72C do not contact the linear guide members 91Y, 91M, and 91C. To address this difficulty, the oblique portion 902 may be provided to the guide members 91Y, 91M, and 91C similar to the guide member 91K. However, upon removal of the image forming units, the oblique portion 902 may interfere with the image forming units. Furthermore, the number of constituent parts for the moving devices 170Y, 170M, and 170C increases, resulting in an increase in the cost.

Depending on the configuration of the image forming apparatus, the second closest writing head to the shaft 51, in this embodiment, the writing head 70C, may enter the area T when removing the image forming unit 1K. In this case, similar to the writing head 70K, the second closest writing head 70C relative to the shaft 51 may be retracted more to the end portion of the housing 90 (the shaft 51 side), than the writing heads 70Y and 70M.

When closing the middle cover 40 to move the writing head 70K from the retracted position to the engaged position, the writing head 70K separates from the shaft 51 while the first rotary member 72K is guided by the oblique portion 902. As the middle cover 40 is further closed, the first rotary member 72K separates from the oblique portion 902 of the guide member 91K immediately before the third rotary member 105K reaches the same height as the shaft 51. Subsequently, as the middle cover 40 is closed further, the third rotary member 105K is positioned lower than the shaft 51. As the motion of the third rotary member 105K in the horizontal (left-right direction) direction changes such that the third rotary member 105K approaches the shaft 51, the first rotary member 72 contacts the linear portion 901 of the guide member 91K. Then, as the middle cover 40 is closed further, the first rotary member 72K is pressed by the linear portion 901 of the guide member 91K, causing the second rotary member 104K to separate from the shaft 51 in the guide hole 42K. The second arm 102K swingably moves in the opposite direction of the direction of arrow D shown in FIG. 8. Accordingly, the first rotary member 72K moves along the linear portion 901 of the guide member 91K, thereby moving linearly in the vertical direction.

Closing further the middle cover 40 causes the second rotary member 104K to contact the end portion of the guide hole 42K at the other end of the shaft 51 side. Closing further the middle cover 40 from the state described above causes the first arm 101K to swingably move in the opposite direction of the direction B shown in FIG. 8 against the force of the torsion spring 103K due to the linear portion 901 of the guide member 91K. As a result, the first rotary member 72K is guided and moved linearly in the vertical direction by the linear member 901 of the guide member 91K. The writing head 70K moves linearly in the vertical direction in the housing 90, thereby fitting the projections 53*a* into the positioning holes 701*a* and 701*b*.

According to the present illustrative embodiment, the second rotary member 104K contacts the end portion of the guide hole 42K, thereby restricting the range of movement of the second arm 102K. Alternatively, the middle cover 40 may include a projection that contacts the second arm 102K to restrict movement of the second arm 102K.

Although the embodiment of the present invention has been described above, the present invention is not limited to the foregoing embodiments, but a variety of modifications can be made within the scope of the present invention. According to an aspect of the disclosure, an image forming apparatus includes a plurality of latent image bearing members (e.g., the photosensitive drums 2Y, M, 2C, and 2K) to rotate about a shaft and bear a latent image on a surface thereof; a plurality of latent image forming devices (e.g., the writing heads 70K, 70C, 70M, and 70Y) to form the latent image on the surface of the plurality of latent image bearing members; a housing (e.g., the housing 90) including an opening, to house the plurality of latent image bearing members and the plurality of latent image forming devices; and a holder (e.g., the middle cover 40) with one end thereof pivotally supported by the housing, the holder openably closable relative to the opening of the housing to hold and move the plurality of latent image forming devices from an engaged position at which the plurality of latent image forming devices forms the latent image to a retracted position at which the latent image forming devices are separated from the latent image bearing members as the holder moves to an open position at which the opening is opened. In a state in which the holder is opened, at least one of the plurality of latent image forming devices, which is closest to a fulcrum of the holder among the plurality of latent image forming devices, is positioned on a line L2 substantially at an end of the housing pivotally supporting the holder relative to a line L1 connecting other latent image forming devices as viewed from an axial direction of the latent image bearing member.

With this configuration, the latent image forming devices are prevented from contacting other components in the housing upon removal of the components and hence prevented from getting damaged.

According to an aspect of the disclosure, in a case in which the holder is opened, an angle between the holder and a direction in which the plurality of latent image bearing members is arranged is equal to or less than 90 degrees.

With this configuration, even when the holder cannot be opened more than 90 degrees, the latent image forming devices are prevented from contacting components in the housing upon removal of the components and hence prevented from getting damaged.

According to an aspect of the disclosure, at least in the vicinity of the engaged position, the plurality of latent image forming devices (e.g., the writing heads 70) moves linearly in a direction perpendicular to the opening of the housing (e.g., the housing 90).

With this configuration, imaging devices such as a developing device and a charging device can be disposed near the latent image forming devices, thereby downsizing the image forming apparatus.

According to an aspect of the disclosure, after the at least one of the plurality of latent image forming devices such as the writing heads 70, which is disposed closest to the fulcrum of the holder such as the middle cover 40, moves linearly in the direction perpendicular to the opening of the housing such as the housing 90, the at least one of the plurality of latent image forming devices closest to the fulcrum of the holder moves pivotally to the end of the housing pivotally supporting the holder to move from the engaged position to the retracted position.

With this configuration, when the holder is opened, the latent image forming device (e.g., the image forming device 1K) closest to the fulcrum of the holder is positioned at the end side of the housing relative to a line L1 connecting other latent image forming devices.

According to an aspect of the disclosure, the image forming apparatus further includes a moving device (e.g., the moving device 170) pivotally supported by the holder. The at least one of the plurality of latent image forming devices closest to the fulcrum of the holder is held by the holder via the moving device, and the retracted position of the latent image forming device is at the end of the housing pivotally supporting the holder relative to a fulcrum of the moving device.

With this configuration, the latent image forming devices are separated from the area T in which components such as the image forming unit 1K in the housing pass upon removal as compared with retracting the latent image forming devices beyond the fulcrum of the moving device 170 in the holder moving direction. With this configuration, the latent image forming devices are prevented from contacting the components in the housing upon removal of the components and hence prevented from getting damaged.

The moving device of the at least one of the plurality of latent image forming devices closest to the fulcrum of the holder comprises a first arm (e.g., the first arm 101K) to hold the latent image forming device and a second arm (e.g., the second arm 102) pivotally supported by the holder to pivotally support the first arm.

With this configuration, when moving the latent image forming device from the engaged position to the retracted position, the latent image forming device is moved to the retracted position after the latent image forming device is moved linearly.

According to an aspect of the disclosure, the housing includes a guide member (e.g., the guide member 91), and the moving device includes a moving member (e.g., the first rotary member 72). As the latent image forming device moves between the engaged position and the retracted position, the moving member contacts the guide member and the guide member guides the moving member.

With this configuration, the guide member 91 guides the latent image forming device to move linearly in the housing. Furthermore, the guide member guides the latent image forming device to a positioning member (e.g., the projection 53*a*), thereby reliably and smoothly fitting the latent image forming device to the positioning member.

According to another aspect of the disclosure, the guide member guides the at least one of the plurality of latent image forming devices closest to the fulcrum of the holder, and includes a linear portion (the linear portion 901) extending in a direction perpendicular to the opening of the housing and an oblique portion (the oblique portion 902) obliquely extending to the opening, the oblique portion being oblique from an end portion of the linear portion at the opening side to the end portion of the housing pivotally supporting the cover.

With this configuration, after the latent image forming device is moved linearly by the guide member, the latent image forming device is moved to the retracted position.

According to another aspect of the disclosure, the moving member includes a biasing member (e.g., the torsion spring 78, 103K) to bias the moving device (the moving device 170) in a direction in which the moving member contacts the guide member.

With this configuration, even when the image forming apparatus vibrates or some stress is applied thereto while the latent image forming device is moved between the engaged position and the retracted position, the moving member (e.g., the rotary member 72) is prevented from separating from the guide member. While moving between the engaged position and the retracted position, the latent image forming device is prevented from coming into contact with the components in the housing.

According to another aspect of the disclosure, the guide member and the moving member are disposed at both ends of the shaft of the latent image bearing member, thereby reliably guiding the latent image forming device in the housing.

According to another aspect of the disclosure, the image forming apparatus includes a restriction member (e.g. the guide hole 42K) to restrict movement of the moving device beyond a predetermined angle.

With this configuration, even when the image forming apparatus vibrates, the restriction member prevents the moving device from moving beyond a predetermined angle. The writing head is prevented from contacting other components.

The opening of the housing allows at least one of devices in the housing to be removed therefrom, thereby facilitating replacement of the parts.

According to another aspect of the disclosure, the plurality of latent image forming devices includes a plurality of light emitting elements such as LEDs and an organic EL devices arranged in the axial direction of the latent image bearing member. With this configuration, an optimum latent image is produced, thus producing a high-quality image.

The housing includes a sheet delivery area in which a recording medium is delivered in a direction perpendicular to the opening, and the fulcrum of the holder is at an end portion of an opposite side of the sheet delivery area. With this configuration, the length of the holder can be reduced, and the holder can be opened even in a limited space above the holder while achieving cost reduction. Even when paper jams occur in the sheet delivery path, the holder does not hider removal of the jammed paper with a simple configuration, which reduces cost.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a plurality of latent image bearing members to rotate about a shaft and bear a latent image on a surface thereof;

a plurality of latent image forming devices to form the latent image on the surface of the plurality of latent image bearing members;

a housing including an opening, to house the plurality of latent image bearing members and the plurality of latent image forming devices;

an openably closable holder with one end thereof pivotally supported by the housing, to move the plurality of latent image forming devices from an engaged position at which the plurality of latent image forming devices forms the latent image to a retracted position at which the plurality of latent image forming devices is separated from the plurality of latent image bearing members by moving to an open position at which the opening of the housing is opened; and a plurality of moving devices pivotally supported by the holder, wherein, in a state in which the holder moves to the open position, at least one of the plurality of latent image forming devices closest to a fulcrum of the holder is positioned at an end of the housing in which the housing pivotally supports the holder relative to a line connecting other latent image forming devices as viewed from an axial direction of the latent image bearing member, wherein each of the plurality of latent image forming devices is swingable held and rotatable about a shaft relative to the holder by the plurality of moving devices, respectively, and wherein, when the holder is fully opened and parallel in a vertical direction, the moving device of the at least one of the plurality of latent image forming devices closest to the fulcrum of the holder is positioned closer to an end portion of the housing as compared to the other moving devices, and the shaft of the moving device of the latent image forming device closest to the fulcrum is aligned at a different vertical line as compared to a vertical line of the shafts of the other moving devices.

2. The image forming apparatus according to claim 1, wherein in a case in which the holder is at the open position, an angle between the holder and a direction in which the plurality of latent image bearing members is arranged is equal to or less than 90 degrees.

3. The image forming apparatus according to claim 1, wherein at least in the vicinity of the engaged position, the plurality of latent image forming devices moves linearly in a direction perpendicular to the opening of the housing.

4. The image forming apparatus according to claim 1, wherein after the at least one of the plurality of latent image forming devices closest to the fulcrum of the holder moves linearly in the direction perpendicular to the opening of the housing, the at least one of the plurality of latent image forming devices closest to the fulcrum of the holder moves pivotally to the end of the housing pivotally supporting the holder so as to move from the engaged position to the retracted position.

5. The image forming apparatus according to claim 1, wherein the retracted position of the latent image forming device closest to the fulcrum of the holder is at the end of the housing pivotally supporting the holder relative to a fulcrum of the moving device.

6. The image forming apparatus according to claim 5, wherein the moving device of the at least one of the plurality of latent image forming devices closest to the fulcrum of the holder comprises a first arm to hold the latent image forming device and a second arm pivotally supported by the holder to pivotally support the first arm.

7. The image forming apparatus according to claim 5, wherein the housing includes a guide member, and the moving device includes a moving member, wherein as the latent image forming device moves between the engaged position and the retracted position, the moving member contacts the guide member and the guide member guides the moving member.

8. The image forming apparatus according to claim 7, wherein the guide member guides the at least one of the plurality of latent image forming devices closest to the fulcrum of the holder, and includes a linear portion extending in a direction perpendicular to the opening of the housing and an oblique portion obliquely extending to the opening, the oblique portion being oblique from an end portion of the linear portion at the opening side to the end portion of the housing pivotally supporting the holder.

9. The image forming apparatus according to claim 7, wherein the moving member includes a biasing member to bias the moving device in a direction in which the moving member contacts the guide member.

10. The image forming apparatus according to claim 7, wherein the guide member and the moving member are disposed at both ends of a shaft of the latent image bearing member.

11. The image forming apparatus according to claim 5, further comprising a restriction member to restrict movement of the moving device beyond a predetermined angle.

12. The image forming apparatus according to claim 1, wherein the opening of the housing allows at least one of devices in the housing to be removed therefrom.

13. The image forming apparatus according to claim 1, wherein the plurality of latent image forming devices includes a plurality of light emitting elements arranged in the axial direction of the latent image bearing member, and the plurality of light emitting elements includes at least one of LED and an organic EL device.

14. The image forming apparatus according to claim 1, wherein the housing includes a sheet delivery area in which a recording medium is delivered in a direction perpendicular to the opening, and the fulcrum of the holder is disposed at an end portion of an opposite side of the sheet delivery area.

15. The image forming apparatus according to claim 1, wherein the moving device of the at least one of the plurality of latent image forming devices closest to the fulcrum of the holder includes a first arm to hold the latent image forming device and a second arm pivotally supported by the holder to pivotally support the first arm.

16. The image forming apparatus according to claim 15, further comprising a biasing member, wherein the biasing member is interposed between the first arm and the second arm.

17. The image forming apparatus according to claim 15, further comprising:

a first rotary member extending from the moving device of the at least one of the plurality of latent image forming devices closest to the fulcrum of the holder, and being rotatably attached to an end of the first arm; and a second rotary member fixed near a center of the second arm.

18. The image forming apparatus according to claim 17, further comprising a guide hole, wherein the second rotary member penetrates through the second arm and the guide hole.

19. The image forming apparatus according to claim 18, wherein the guide hole is curved shaped.

* * * * *